US007628711B2

(12) United States Patent
Akinori et al.

(10) Patent No.: US 7,628,711 B2
(45) Date of Patent: Dec. 8, 2009

(54) GOLF CLUB HEAD

(75) Inventors: Sasamoto Akinori, Kiyose (JP); Cheng-Tao Lee, Kaohsiung (TW); Yuan-Jen Hou, Kaohsiung (TW); Te-Fu Hsiao, Kaohsiung (TW)

(73) Assignee: Advanced International Multitech Co., Ltd., Kaohiung (TW)

( * ) Notice: Subject to any disclaimer, the term of this patent is extended or adjusted under 35 U.S.C. 154(b) by 0 days.

(21) Appl. No.: 12/148,693

(22) Filed: Apr. 22, 2008

(65) Prior Publication Data

US 2009/0131200 A1 May 21, 2009

(30) Foreign Application Priority Data

Nov. 20, 2007 (TW) ..... 96219586 U

(51) Int. Cl.
*A63B 53/06* (2006.01)
*E01B 9/12* (2006.01)

(52) U.S. Cl. ..... 473/335; 411/337; 411/432

(58) Field of Classification Search ..... 473/334–335, 473/337–339; 411/337–339, 354, 432
See application file for complete search history.

(56) References Cited

U.S. PATENT DOCUMENTS 3,443,783 A * 5/1969 Fisher ..... 248/239
3,921,261 A * 11/1975 Fisher ..... 24/580.1
4,341,053 A * 7/1982 Dettfurth et al. ..... 52/787.1
4,762,437 A * 8/1988 Mitomi ..... 403/11
5,242,167 A * 9/1993 Antonious ..... 473/350
5,433,444 A * 7/1995 Chiuminatta et al. ..... 473/240
6,302,633 B1 * 10/2001 Poe ..... 411/432
6,568,893 B2 * 5/2003 LeVey et al. ..... 411/349
6,711,865 B2 * 3/2004 Chaudoreille ..... 52/603
6,955,515 B2 * 10/2005 Barina et al. ..... 411/508
7,153,220 B2 * 12/2006 Lo ..... 473/335
2006/0178229 A1 * 8/2006 Liang et al. ..... 473/334
2008/0132353 A1 * 6/2008 Hsiao ..... 473/336
2008/0280698 A1 * 11/2008 Hoffman et al. ..... 473/337

FOREIGN PATENT DOCUMENTS

TW 224017 B 11/2004
TW 227675 B 2/2005
TW 234474 B 6/2006
TW 274598 B 3/2007

* cited by examiner

*Primary Examiner*—Stephen L. Blau

(57) ABSTRACT

A golf club head includes a head body formed with a cavity, and a counterweight unit fitted in the cavity and including a sleeve body and an insert body. The sleeve body has a first end face, a second end face, first and second cavities, and first and second inner walls. The first inner wall has at least one first corner. The second inner wall has at least one second corner out of alignment with the first corner. The sleeve body further has at least one shoulder face formed at a junction of the first and second cavities. The insert body includes an insert portion removably inserted into the sleeve body, and an abutting portion extending outward from the sleeve body and abutting against the first end face. The insert portion has at least one flange engaging the second corner and having a stop face abutting against the shoulder face.

11 Claims, 10 Drawing Sheets

GOLF CLUB HEAD

CROSS-REFERENCE TO RELATED APPLICATION

This application claims priority of Taiwanese Application No. 096219586, filed on Nov. 20, 2007.

BACKGROUND OF THE INVENTION

1. Field of the Invention

The invention relates to a golf club head, more particularly to a golf club head having an improved weight distribution design.

2. Description of the Related Art

When choosing a golf club head, the factors to be considered primarily include controllability and stability. Therefore, the golf player should choose a golf club head having a good weight distribution design so as to increase the controllability and stability. Conventionally, the method for the weight distribution design of the golf club head includes providing a counterweight unit that is usually assembled to the golf club head by welding or through screws.

In Taiwanese Patent Nos. I224017 and I227675, a counterweight unit is bonded to a golf club head by welding so as to lower a gravity center of the golf club head. Since the counterweight unit is bonded to the golf club head by welding, the gravity center of the golf club head is not adjustable according to the specific striking requirements of the golfer. Furthermore, the shock absorption of the golf club heads of the prior art is unsatisfactory.

In Taiwanese Utility Model Nos. M282718, M265079, and M283663, and Taiwanese Patent No. I234474, the counterweight unit is attached to the golf club head using screws. However, assembly of the counterweight unit to the golf club head with the use of screws is relatively troublesome.

Referring to FIGS. 1 and 2, a golf club head disclosed in Taiwanese Patent No. I274598 includes a head body 10 and two counterweight units 10', each of which includes a sleeve body 11 and an insert body 12.

The head body 10 has two cavities 101 provided at the back of the head body 10 and spaced apart from each other. The sleeve body 11 is fitted in a corresponding one of the cavities 101, and has four anchoring recesses 111 recessed from an inner surface thereof and equiangularly spaced apart from each other. The insert body 12 includes an insert portion 121, and four flanges 122 that protrude radially from the insert portion 121 and that are equiangularly spaced apart from each other. Each of the flanges 122 is capable of being anchored in a corresponding one of the anchoring recesses 111 by inserting the insert body 12 into the sleeve body 11 and then rotating the insert body 12 relative to the sleeve body 11.

The gravity center of the golf club head is adjustable using the insert body 12 having a specific gravity different from that of the head body 10.

Referring to FIG. 2, since the insert body 12 is assembled to the sleeve body 11 merely by anchoring the flanges 122 into the anchoring recesses 111, the bonding strength between the insert body 12 and the sleeve body 11 is relatively weak. The stability of the golf club head is unsatisfactory, and the insert body 12 is liable to separate from the sleeve body 11 when a golf ball is struck.

SUMMARY OF THE INVENTION

Therefore, an object of the present invention is to provide a golf club head which is easy to assemble, which is improved in bonding strength of a counterweight unit used therein, and which is flexible in adjusting its weight distribution.

Accordingly, the golf club head of this invention includes a head body formed with a cavity having an opening at an outer surface of the head body, and a counterweight unit fitted in the cavity and including a sleeve body and an insert body. The sleeve body has a first end face, a second end face opposite to the first end face and extending to the depth of the cavity, first and second cavities adjoining each other and respectively extending through the first and second end faces, and first and second inner walls respectively confining the first and second cavities. The first inner wall has at least one first corner. The second inner wall has at least one second corner. The second corner is out of alignment with the first corner. The sleeve body further has at least one shoulder face which is formed at a junction of the first and second cavities in the vicinity of the second corner and which faces the second end face. The insert body includes an insert portion removably inserted into the sleeve body, and an abutting portion extending outward from the sleeve body and abutting against the first end face. The insert portion has at least one flange that engages the second corner and that has a stop face abutting against the shoulder face.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
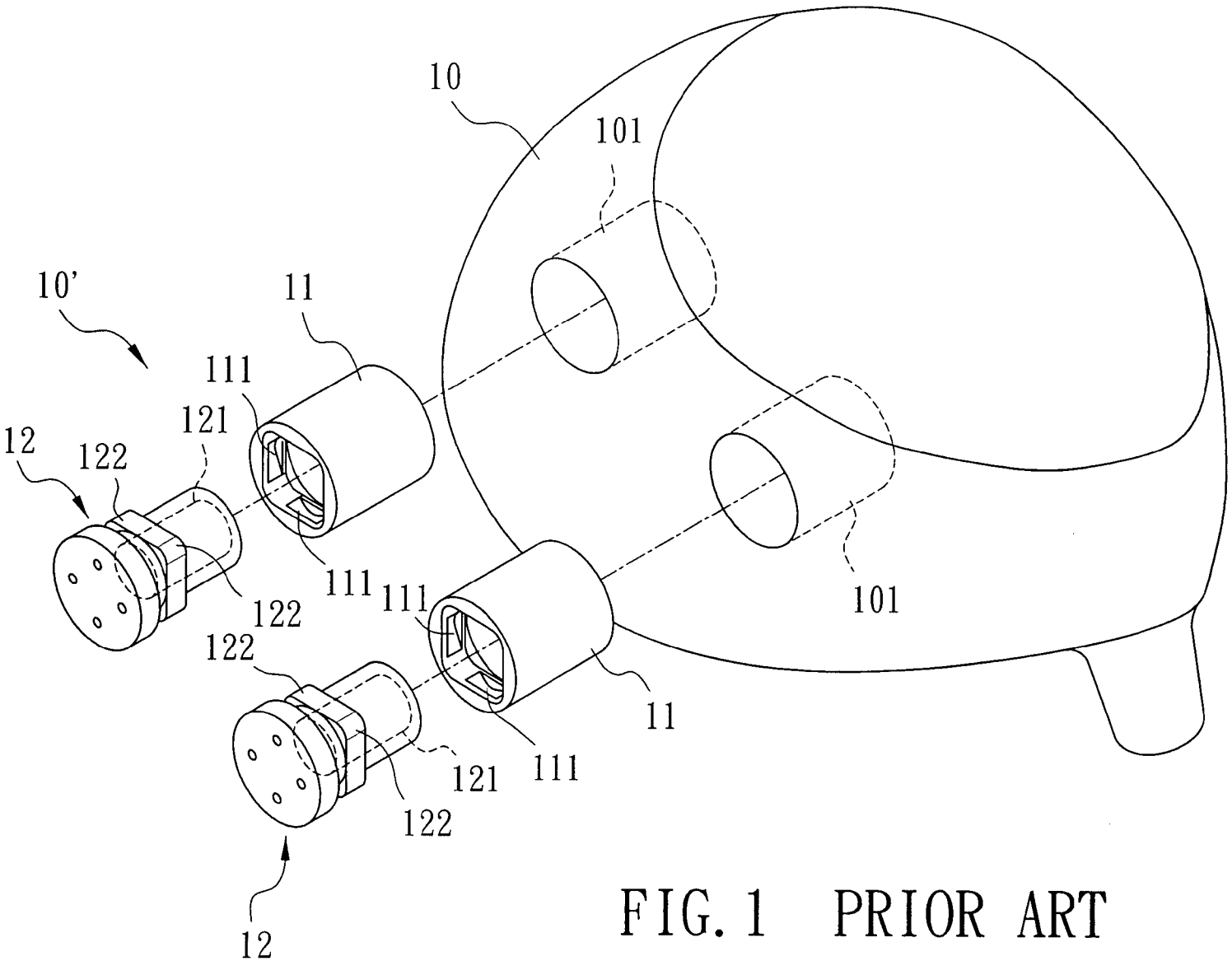
FIG. 1 PRIOR ART
FIG. 1 is an exploded perspective view of a conventional golf club head.
Figure 2:
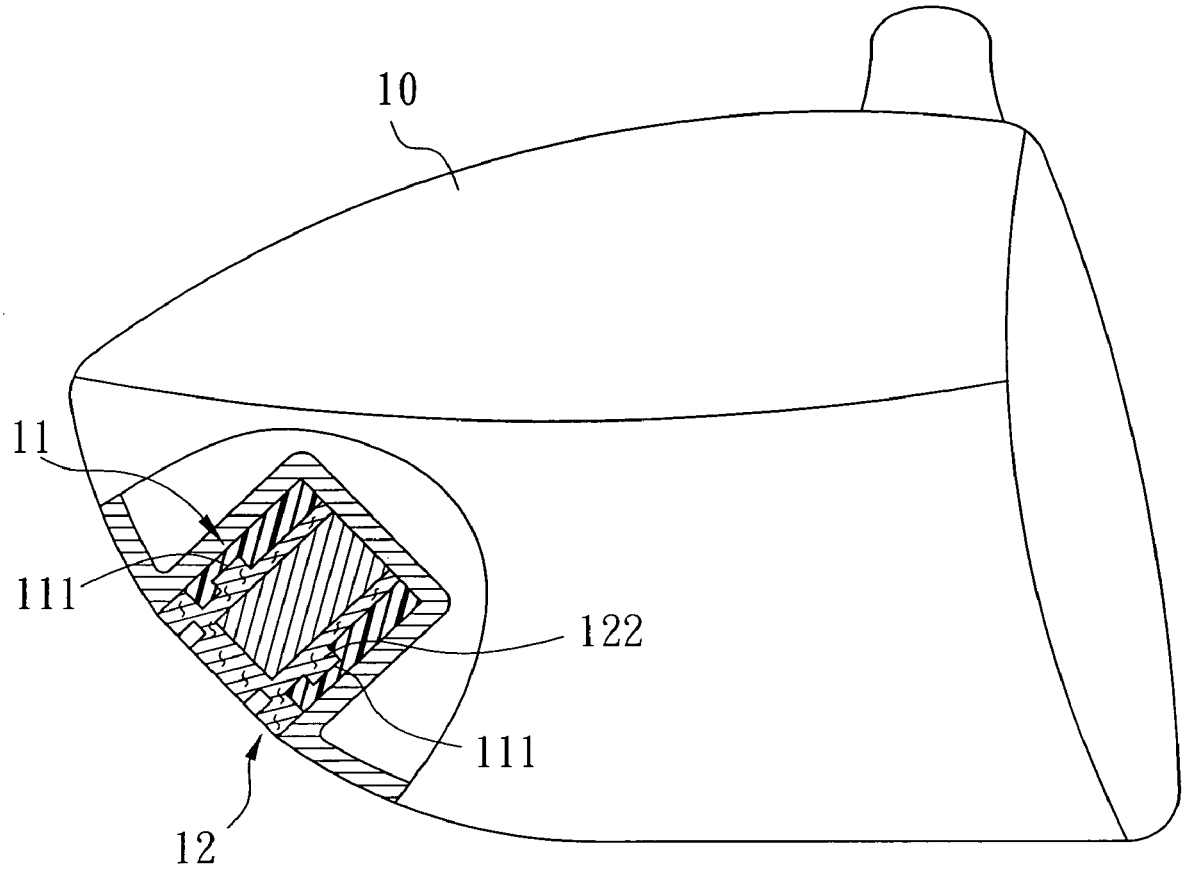
FIG. 2 PRIOR ART
FIG. 2 is a partly sectional schematic view of the conventional golf club head.

Before the present invention is described in greater detail, it should be noted that like elements are denoted by the same reference numerals throughout the disclosure.

Figure 3:
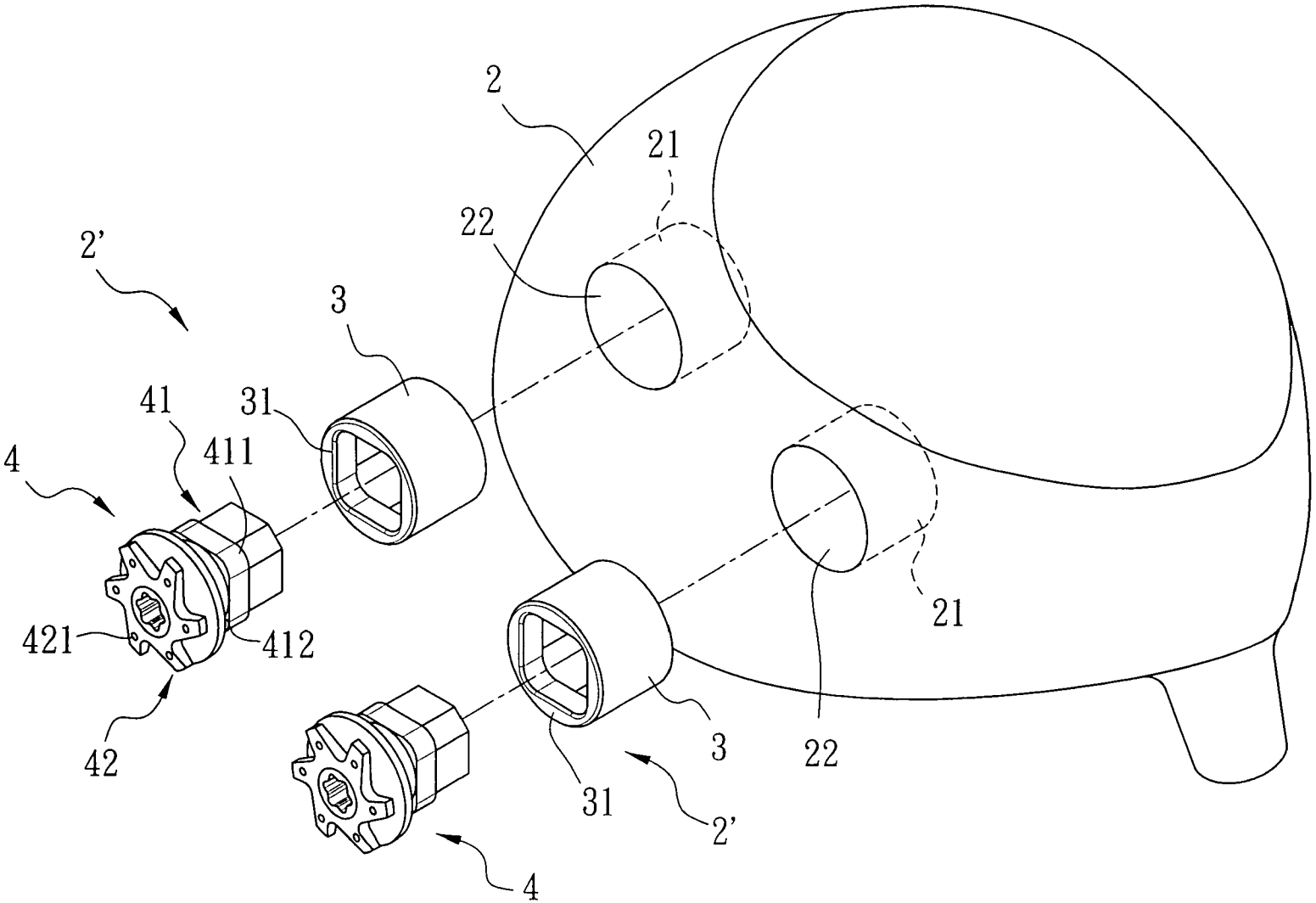
FIG. 3 is an exploded perspective view of a first preferred embodiment of a golf club head according to this invention.

Referring to FIG. 3, the first preferred embodiment of a golf club head according to this invention is shown to include a head body 2 and two counterweight units 2'.

The head body 2 is formed with two cavities 21 provided at the back of the head body 2 and spaced apart from each other. Each of the cavities 21 has an opening 22 at an outer surface of the head body 2. The head body 2 is made of titanium alloy, stainless steel, carbon steel, or the like.

Each of the counterweight units 2' is fitted in a corresponding one of the cavities 21, and includes a sleeve body 3 and an insert body 4.

Figure 4:
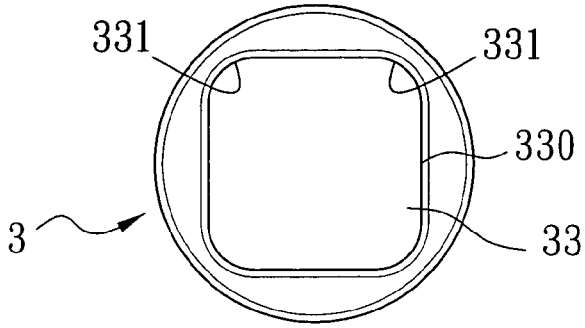
FIG. 4 is a front schematic view of a sleeve body used in the first preferred embodiment.
Figure 5:
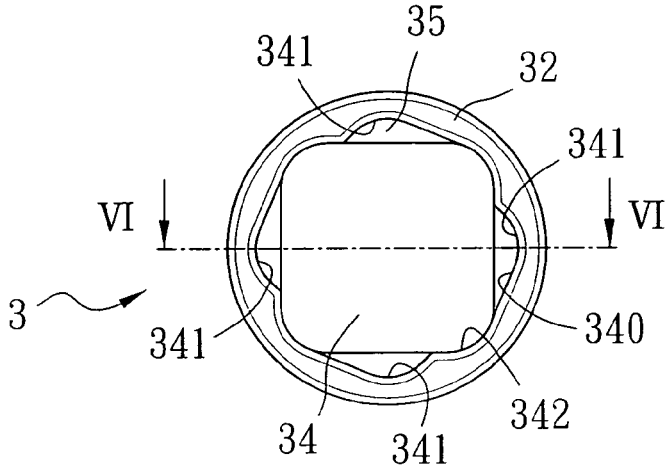
FIG. 5 is a rear schematic view of the sleeve body.
Figure 6:
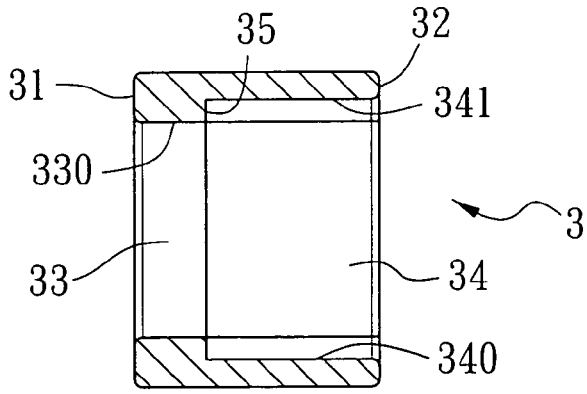
FIG. 6 is a sectional view of the sleeve body, taken along line VI-VI in FIG. 5.

Referring to FIGS. 4, 5, and 6, the sleeve body 3 is made of plastic, rubber, metal, or the like, and has a first end face 31, a second end face 32 opposite to the first end face 31 and extending to the depth of the corresponding one of the cavities 21, first and second cavities 33, 34 adjoining each other and respectively extending through the first and second end faces 31, 32, and first and second inner walls 330, 340 respectively confining the first and second cavities 33, 34. The first inner wall 330 is square in cross section, and has four first corners 331. The second inner wall 340 has four second corners 341 and four third corners 342. The second corners 341 are out of alignment with the first corners 331. The third corners 342 are respectively aligned with the first corners 331 and alternate with the second corners 341.

The sleeve body 3 further has four shoulder faces 35, which are formed at a junction of the first and second cavities 33, 34 in the vicinity of the second corners 341 and which face the second end face 32.

The insert body 4 includes an insert portion 41 removably inserted into the sleeve body 3, and an abutting portion 42 extending outward from the sleeve body 3 and abutting against the first end face 31. The insert portion 41 has four flanges 411 that respectively engage the second corners 341 and that have stop faces 412 abutting against the shoulder faces 35, respectively.

Each of the insert portion 41 and the abutting portion 42 is made of a material having a specific gravity greater than that of the head body 2 so as to lower the gravity center of the golf club head. The material suitable for the insert portion 41 and the abutting portion 42 includes stainless steel, carbon steel, aluminum alloy, magnesium alloy, titanium alloy, copper alloy, zinc alloy, tungsten alloy, stone, wood, plastic, rubber, or the like. Preferably, each of the insert portion 41 and the abutting portion 42 has a specific gravity ranging from 1.7 to 18 g/cm$^3$. The specific gravity of the insert portion 41 can be identical to or different from that of the abutting portion 42.

Figure 7:
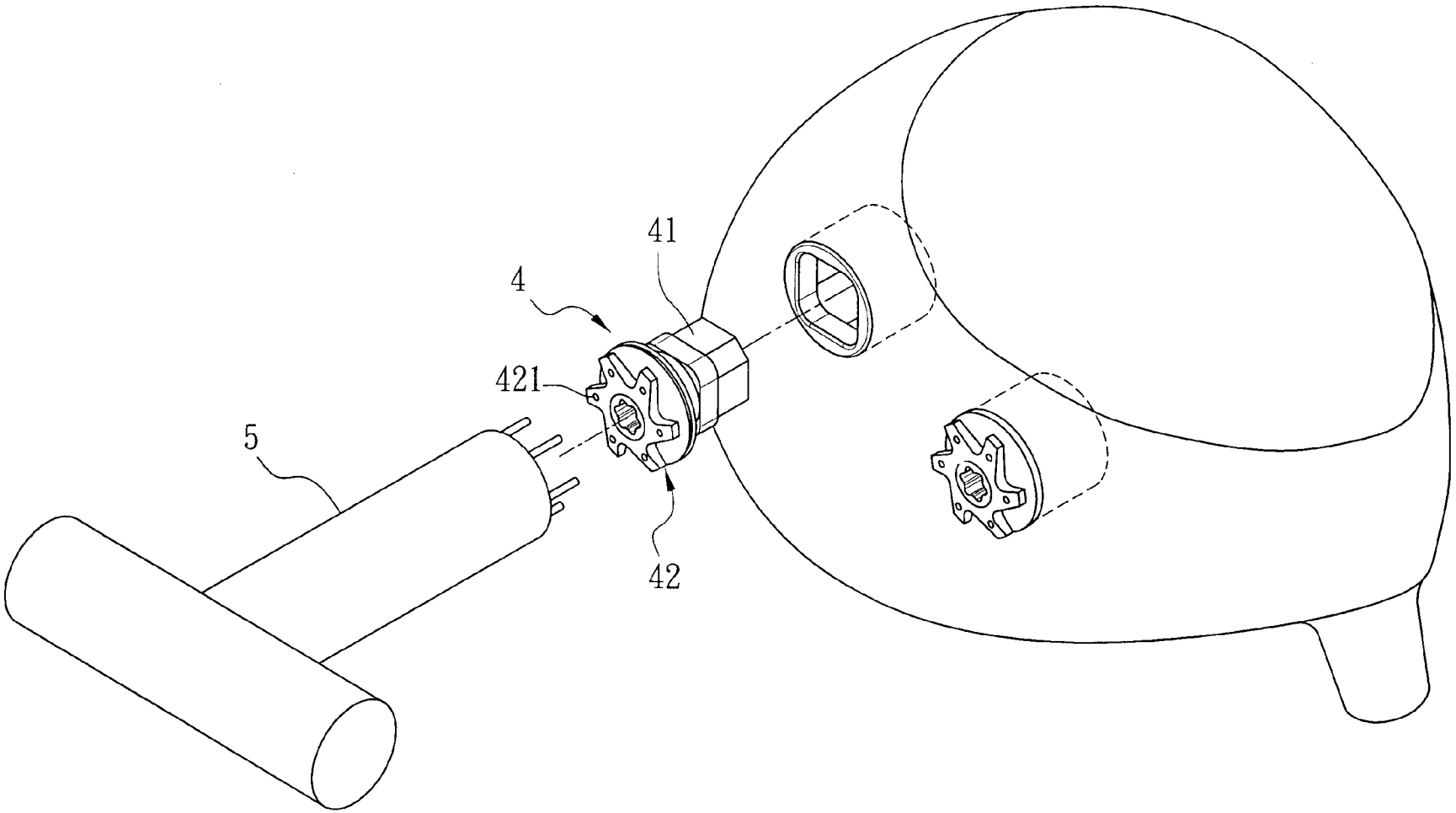
FIG. 7 is a perspective view illustrating how the first preferred embodiment is assembled.
Figure 8:
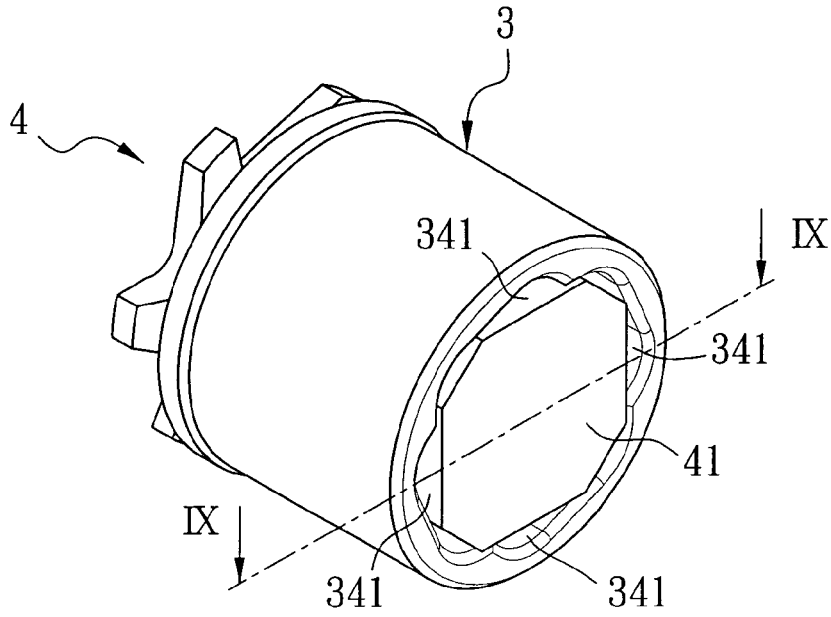
FIG. 8 is a perspective view of a counterweight unit used in the first preferred embodiment in a disengaged state.
Figure 9:
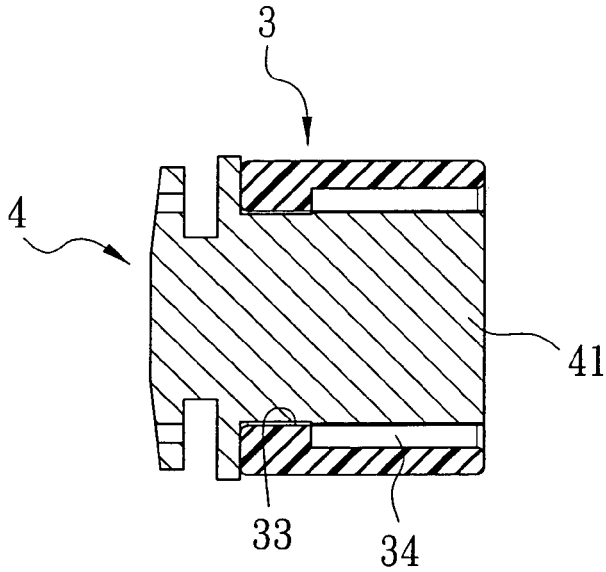
FIG. 9 is a sectional view of the counterweight unit, taken along line IX-IX in FIG. 8.
Figure 10:
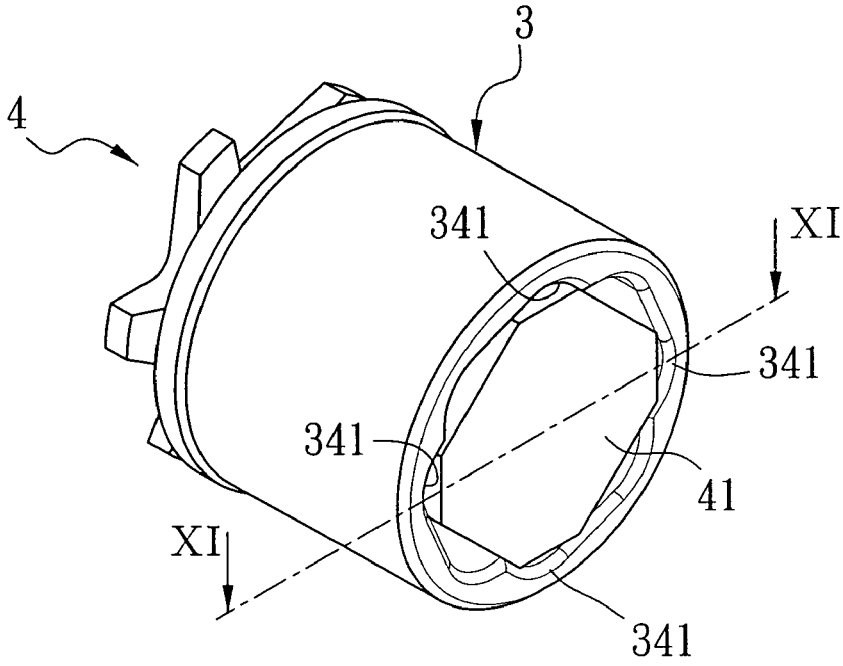
FIG. 10 is a perspective view of the counterweight unit in a state of engagement.
Figure 11:
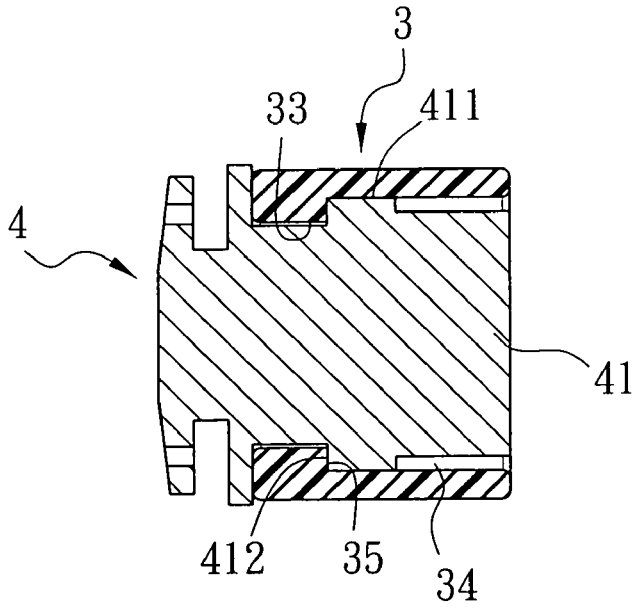
FIG. 11 is a sectional view of the counterweight unit, taken along line XI-XI in FIG. 10.

Referring to FIG. 7, the abutting portion 42 of the insert body 4 is formed with a plurality of tool-inserting holes 421 opposite to the insert portion 41. A tool 5 can be inserted into the tool-insert holes 421 so as to rotate the insert body 4 relative to the sleeve body 3 to interengage the insert body 4 and the sleeve body 3 or to disengage the insert body 4 from the sleeve body 3.

Referring to FIGS. 8, 9, 10, and 11, when assembling the insert body 4 to the sleeve body 3, the insert body 4 is inserted into the sleeve body 3 so that the insert portion 41 of the insert body 11 is inserted into the first and second cavities 33, 34 of the sleeve body 3. The insert body 4 is then rotated using the tool 5 so that the flanges 411 move to and respectively engage the second corners 341 and so that the stop faces 412 abut against the shoulder faces 35, respectively. Since the flanges 411 respectively engage the second corners 341 and since the stop faces 412 respectively abut against the shoulder faces 35, the insert body 4 can be stably and firmly engaged to the sleeve body 3. Therefore, the bonding strength and stability between the insert body 4 and the sleeve body 3 is improved.

Figure 12:
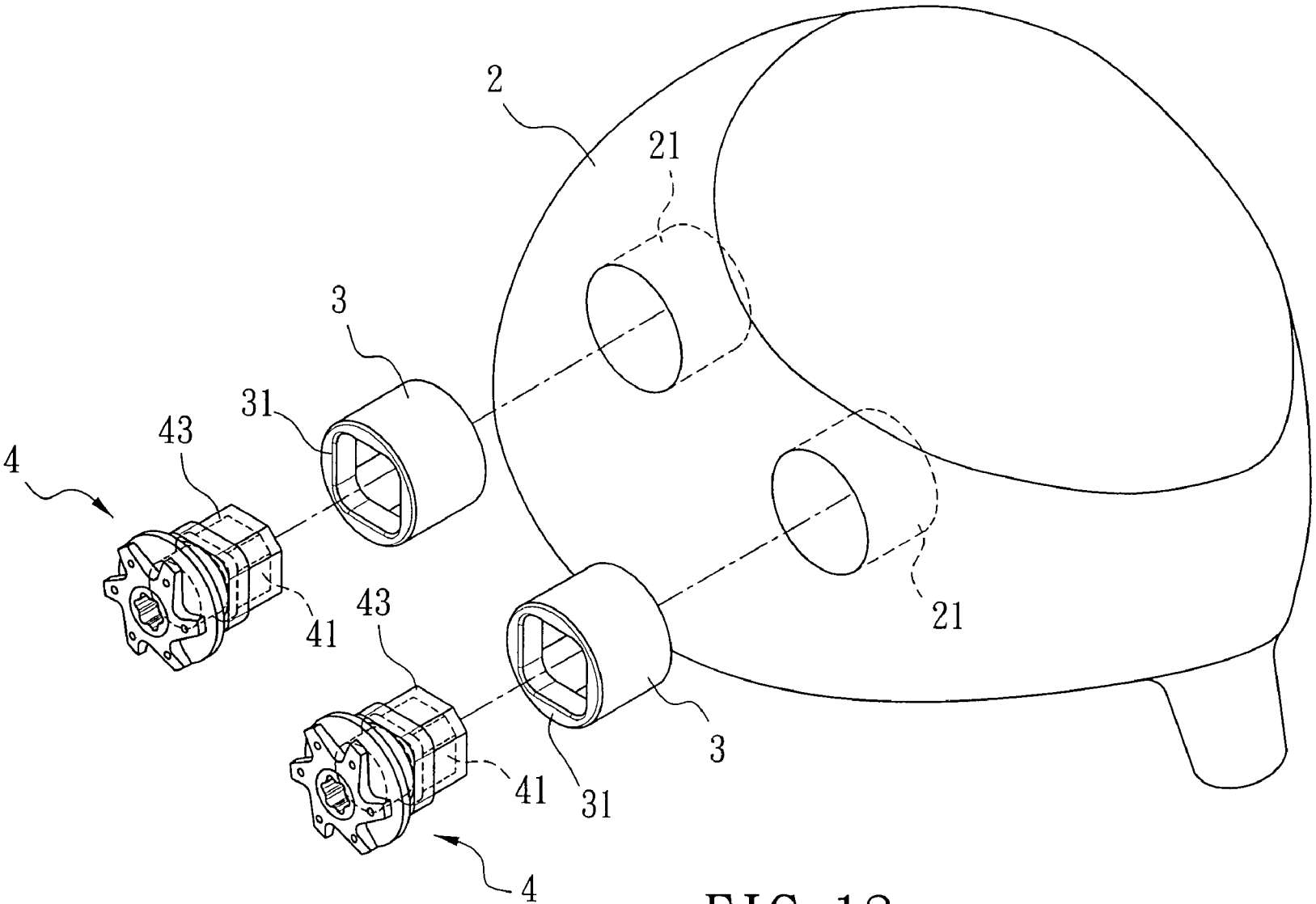
FIG. 12 is an exploded perspective view of a second preferred embodiment of a golf club head according to this invention.
Figure 13:
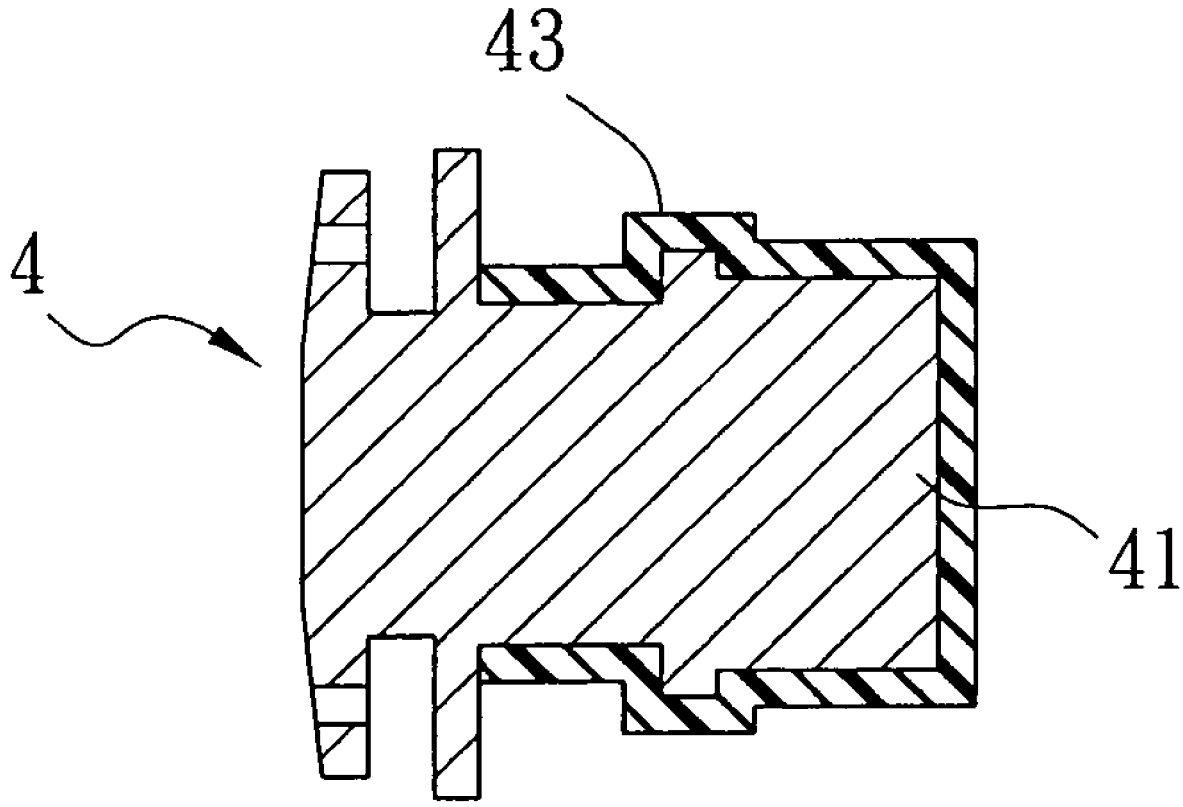
FIG. 13 is a sectional view of an insert body used in the second preferred embodiment.

Referring to FIGS. 12 and 13, the second preferred embodiment of a golf club head according to this invention is shown to be similar to the first embodiment except that the insert body 4 further includes a vibration-absorbing portion 43 mounted on the insert portion 41 so as to improve the shock-absorption of the golf club head. The vibration-absorbing portion 43 is made of plastic, rubber, silicone, resin, carbon fiber, glass fiber, boron fiber, short fiber thermoplastic material, or the like, or a combination thereof.

Figure 14:
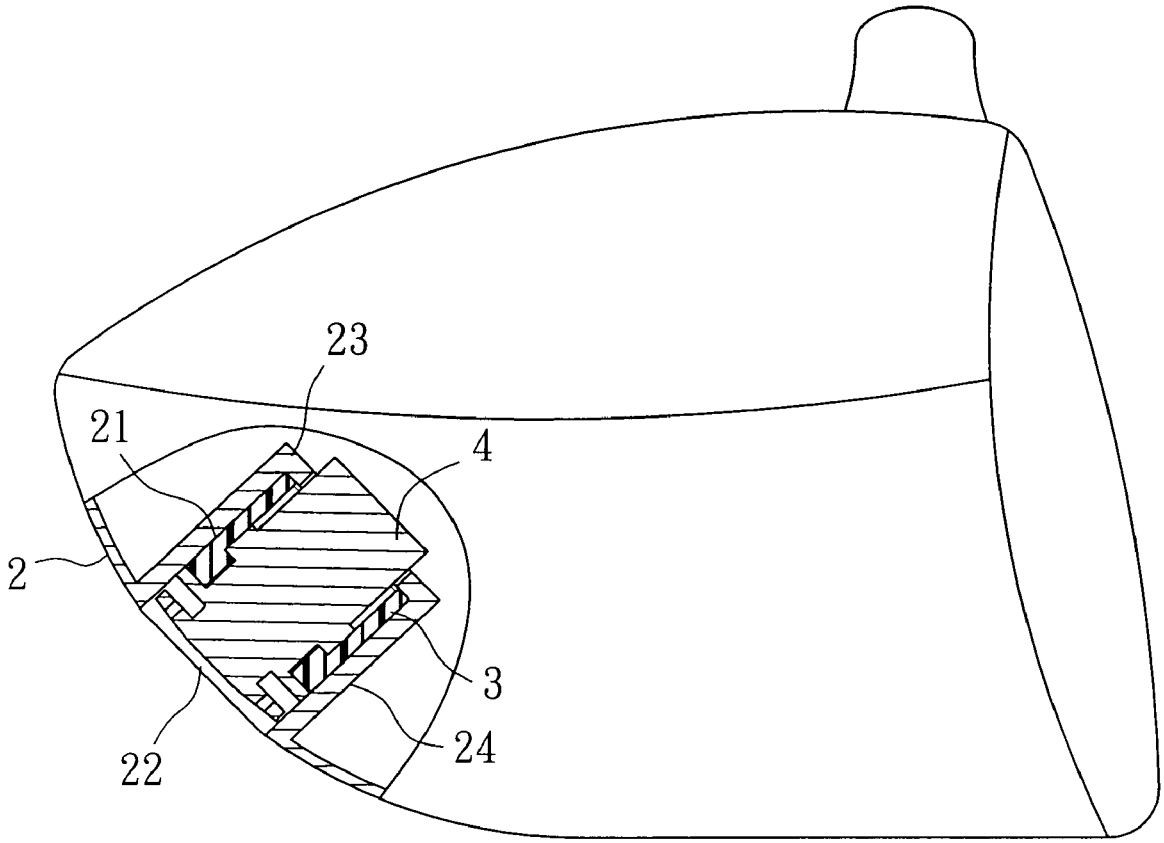
FIG. 14 is a partly sectional schematic view of a third preferred embodiment of a golf club head according to this invention.

Referring to FIG. 14, the third preferred embodiment of a golf club head according to this invention is shown to be similar to the first embodiment except that the cavity 21 is confined by a bottom wall 23 opposite to the opening 22, and a surrounding wall 24 extending inward from the opening 22 to the bottom wall 23. The sleeve body 3 abuts against the bottom wall 23, and the insert body 4 extends through the bottom wall 23. Furthermore, the surrounding wall 24 and the bottom wall 23 have a thickness greater than that of the head body 2.

In view of the aforesaid, the golf club head of this invention is superior over the prior art in terms of bonding strength and stability, shock-absorption, and convenience of assembly. Furthermore, compared to the prior art in which the counterweight unit is assembled to the golf club head through screws, it is not necessary for the present invention to form a threaded cavity in the head body of the golf club head for attaching the counterweight unit to the head body. Therefore, the present invention is advantageous over the prior art in terms of manufacturing time and cost.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A golf club head, comprising:

a head body formed with a cavity having an opening at an outer surface of said head body; and a counterweight unit fitted in said cavity and including a sleeve body and an insert body;

said sleeve body having a first end face, a second end face opposite to said first end face and extending to the depth of said cavity, first and second cavities adjoining each other and respectively extending through said first and second end faces, and first and second inner walls respectively confining said first and second cavities, said first inner wall having at least one first corner wherein said first corner extends to said first end face, said second inner wall having at least one second corner, said second corner being out of alignment wherein said second corner extends to said second end face with said first corner, said sleeve body further having at least one shoulder face which is formed at a junction of said first and second cavities in the vicinity of said second corner and which faces said second end face;

said insert body including an insert portion removably inserted into said sleeve body, and an abutting portion extending outward from said sleeve body and abutting against said first end face, said insert portion having at least one flange that engages said second corner and that has a stop face abutting against said shoulder face.

2. The golf club head as claimed in claim 1, wherein said sleeve body has a plurality of said first corners, a plurality of said second corners, and a plurality of said shoulder faces, and said insert body has a plurality of said flanges respectively engaging said second corners, and a plurality of said stop faces abutting against said shoulder faces, respectively.

3. The golf club head as claimed in claim 2, wherein said second inner wall further has a plurality of third corners that are respectively aligned with said first corners and that alternate with said second corners.

4. The golf club head as claimed in claim 2, wherein said first inner wall is square in cross section, the number of said first corners being four, the number of said second corners being four, said second inner wall further having four third corners alternating with said second corners, said first corners being respectively aligned with said third corners.

5. The golf club head as claimed in claim 1, wherein said insert body further includes a vibration-absorbing portion mounted on said insert portion.

6. The golf club head as claimed in claim 5, wherein said vibration-absorbing portion is made of a material selected from the group consisting of plastic, rubber, and fiber.

7. The golf club head as claimed in claim 1, wherein said abutting portion is formed with a tool-inserting hole opposite to said insert portion.

8. The golf club head as claimed in claim 1, wherein said sleeve body is made of a material selected from the group consisting of plastic, rubber, and metal.

9. The golf club head as claimed in claim 1, wherein each of said insert portion and said abutting portion has a specific gravity ranging from 1.7 to 18 g/cm$^3$.

10. The golf club head as claimed in claim 1, wherein each of said insert portion and said abutting portion is made of a material selected from the group consisting of stainless steel, carbon steel, aluminum alloy, magnesium alloy, titanium alloy, copper alloy, zinc alloy, tungsten alloy, stone, wood, plastic, and rubber.

11. The golf club head as claimed in claim 1, wherein said cavity is confined by a bottom wall opposite to said opening, and a surrounding wall extending inward from said opening to said bottom wall, said sleeve body abutting against said bottom wall, said insert body extending through said bottom wall.

* * * * *